United States Patent [19]

Westhead

[11] 4,274,448

[45] Jun. 23, 1981

[54] DRYER FELT WITH ENCAPSULATED, BULKY CENTER YARNS

[75] Inventor: William T. Westhead, Waycross, Ga.

[73] Assignee: Scapa Dryers, Inc., Waycross, Ga.

[21] Appl. No.: 932,360

[22] Filed: Aug. 9, 1978

[51] Int. Cl.[3] ..... D03D 15/00

[52] U.S. Cl. ..... 139/383 A; 139/412; 139/420 C; 139/425 A; 57/210

[58] Field of Search ..... 139/383 R, 383 A, 408, 139/409, 410, 411, 412, 413, 414, 420 R, 420 G, 426, 425 A, 425 R; 162/348, DIG. 1; 428/280; 57/210

[56] References Cited

U.S. PATENT DOCUMENTS

| | | | |
|---|---|---|---|
| 1,811,573 | 6/1931 | Bacheldor et al. | 139/425 A |
| 2,934,097 | 4/1960 | Hindle et al. | 139/383 A |
| 2,936,796 | 5/1960 | Hindle et al. | 139/383 A |
| 3,049,153 | 8/1962 | Jones | 139/426 |
| 3,653,961 | 4/1972 | Lefkowitz | 139/383 A |
| 4,024,895 | 5/1977 | Barron | 139/426 |
| 4,159,618 | 7/1979 | Sokaris | 57/251 |

*Primary Examiner*—Henry Jaudon
*Attorney, Agent, or Firm*—Fleit & Jacobson

[57] ABSTRACT

A dryer felt comprising a multiple-plane fabric having at least a base plane, a top plane and an intermediate plane positioned between the base plane and the top plane. The base plane is defined by a first plurality of cross machine direction yarns; the top plane is defined by a second plurality of cross machine direction yarns; and the intermediate plane is defined by a third plurality of cross machine direction yarns. In one embodiment encapsulated stuffer yarns constitute the third plurality of cross machine direction yarns. In another embodiment, encapsulated filling yarns constitute the third plurality of cross machine direction yarns.

18 Claims, 5 Drawing Figures

DRYER FELT WITH ENCAPSULATED, BULKY CENTER YARNS

BACKGROUND OF THE INVENTION

1. Field of the Invention

This invention relates to papermaking fabrics, in general, and to dryer felts having improved bulk, in particular.

2. Description of the Prior Art

A conventional dryer felt consists of an endless conveyor belt made from a multi plane fabric, wherein the various planes can be defined either by different groups of cross machine direction yarns, machine direction yarns or both. The planes, or plies, or layers are united by a plurality of machine direction yarns. The yarns used to weave the most up-to-date dryer felts are made from synthetic monofilaments such as polyester or polyamide, or synthetic multifilaments, from such materials as polyester, acrylic, polyamide or the aramid fiber group—NOMEX and KEVLAR.

Because some of the synthetic materials are quite expensive, manufacturers are continually seeking to improve dryer felts, both in terms of cost and in terms of dryer felt reliability. Along these lines, it is important in certain dryer felts to maintain low air permeability, and one way of lowering the permeability is to weave more yarns to the inch. This, of course, adds to the cost and weight of the already expensive felts.

It is toward the development of a relatively inexpensive, low-permeability, light-weight dryer felt that the present invention is directed.

SUMMARY OF THE INVENTION

The improved dryer felt of the subject invention comprises a multiple-plane fabric having a base plane, a top plane and an intermediate plane positioned between the base plane and the top plane. The base plane is defined by a first plurality of cross machine direction yarns. The top plane is defined by a second plurality of cross machine direction yarns. And the intermediate plane is defined by a plurality of bulky encapsulated cross machine direction yarns. In one embodiment, the intermediate plane is defined by a plurality of encapsulated stuffer yarns, and in another embodiment, the intermediate plane is defined by a plurality of encapsulated filling yarns.

By using the encapsulated yarns to define the intermediate plane, a dryer felt is provided which contains many attributes not heretofore found in prior art dryer felts. By using the bulky encapsulated yarns to define the intermediate plane, the permeability of a given dryer felt may be decreased by a desired amount without adding additional yarns per inch to the woven fabric. Accordingly, the use of the encapsulated yarns permits a dryer felt manufacturer to produce a dryer felt having the same permeability as a prior art dryer felt, but using less yarns per inch, thereby reducing manufacturing costs. At the same time, the bulky encapsulated yarns prevent the other yarns of the fabric from shifting, thereby rendering a more stable felt.

It is, thus, an object of the present invention to provide a dryer felt having a desired permeability, but using less yarn than a comparable prior art dryer felt.

It is another object of the present invention to decrease dryer felt permeability without the addition of further yarns.

It is a further object of the present invention to provide an economical and stable dryer felt having an intermediate plane defined by encapsulated stuffer yarns.

It is still a further object of the present invention to provide an economical and stable dryer felt having an intermediate plane defined by encapsulated filling yarns.

Other objects and advantages of this invention will further become apparent hereinafter and in the drawings.

DESCRIPTION OF THE PREFERRED EMBODIMENTS

Figure 1A:
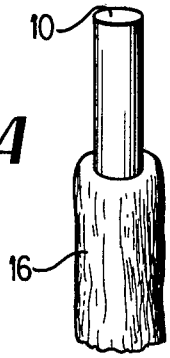
FIGS. 1A and 1B show, in perspective, two embodiments of encapsulated yarns in various stages of assembly.

In describing the preferred embodiments of the invention illustrated in the drawings, specific terminology will be resorted to for the sake of clarity. However, it should be understood that the invention is not to be limited to the specific terms so selected, and it is to be understood that each specific term includes all technical equivalents which operate in a similar manner to accomplish a similar purpose.

Figure 1B:
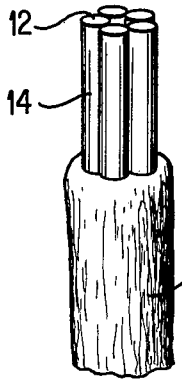

The subject invention will now be described with reference to the figures, in which FIGS. 1A and 1B illustrate two types of encapsulated yarns. At the heart of the encapsulated yarn is a monofilament core, designated as 10 in FIG. 1A and 12 in FIG. 1B. The monofilament core 10 is a monofilament of a single fiber, whereas the monofilament core 12 is composed of a bundle of synthetic fibers 14, treated with a high temperature resistent resin such as phenolic resin, to cause the bundle to act as a monofilament fiber in the woven felt.

The fibers constituting the monofilament cores 10 and 12 are preferably made from polyester. However, the fibers can also be of fibers made from polyamides, arcylics, aramids and polyolefins. It is also possible to employ fine wire and/or rubber-type resin treated glass yarns as core materials.

Each of the monofilament cores 10 and 12 is encapsulated in a sheath or sleeve 16 made from a material producing a soft, bulky texture. Sleeve 16 may be of mineral fibers such as asbestos, natural fibers such as cotton or wool, or synthetic fibers such as polyesters, acrylics, polyamides or aramids. In one embodiment, the sleeve is produced from spun staple fibers in sliver, roving or yarn form. In another embodiment, the sleeve is produced by employing a yarn texturising process. In such a process, a yarn comprising a plurality of filaments made from man-made materials which are not originally or inherently crinkled are rendered bulky by causing the filaments to become crinkled. The plurality of filaments of the yarn is made up of a group of more than one substantially continuous filament, or a plurality of such groups of filaments. Such yarns are sometimes referred to in the textile arts as "textured" yarns. In yet another embodiment, the sleeve is produced by employing natural yarns which are originally or inherently crinkled, such as cotton or wool, and which are not inherently crinkled, such as bast fibers.

Figure 2:
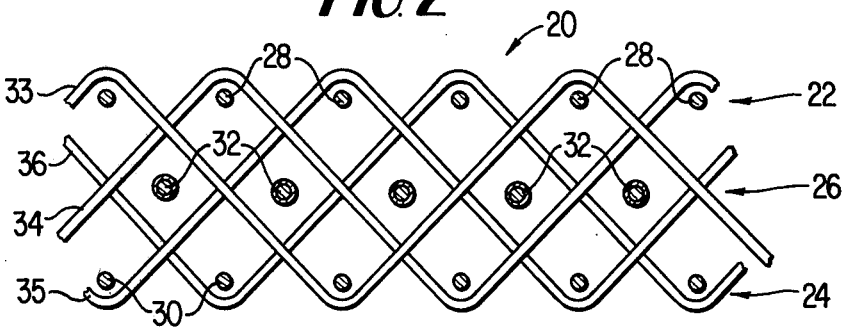
FIG. 2 is a longitudinal section of a duplex weave dryer felt employing the subject invention.

FIG. 2 illustrates a dryer felt embodying the subject invention. The dryer felt, generally designated as 20, is woven into a duplex weave by either the endless or flat weave process. The dryer felt 20 contains three planes; a top plane or top surface 22, a bottom plane or bottom surface 24, and an intermediate plane 26. The top plane, which provides the face of the dryer felt, is defined by a plurality of cross machine direction yarns 28, which are made from a synthetic monofilament, a synthetic multifilament or spun staple fibers (also called spun fiber yarns). The yarn made from the multifilament, or spun staple fibers is preferably stabilized by a resin treatment using for example phenolic resin; but this is not essential, and it would not be done with every type of dryer felt. The bottom plane, which provides the back of the dryer felt, is defined by a plurality of cross machine direction yarns 30, which are made from a synthetic monofilament, synthetic multifilaments or spun fiber yarns. The intermediate plane is defined by a plurality of encapsulated stuffer yarns 32. The yarns defining the various planes are united or bound in place by machine direction yarns 33 through 36, also made from a synthetic monofilament, synthetic multifilaments or spun fiber yarns. The yarn made from the multifilament, on spun staple fibers and used in the bottom and intermediate planes may or may not be stabilized in a similar manner to that of the face yarns previously described. It is to be understood that any dryer felt woven in a multi layer weave can benefit greatly from using the encapsulated stuffer yarns of the subject invention. By adding encapsulated stuffer yarns, stability is enhanced, permeability is reduced, and hence the remaining yarns may be woven more loosely without detracting from the effectiveness of the felt.

Figure 3:
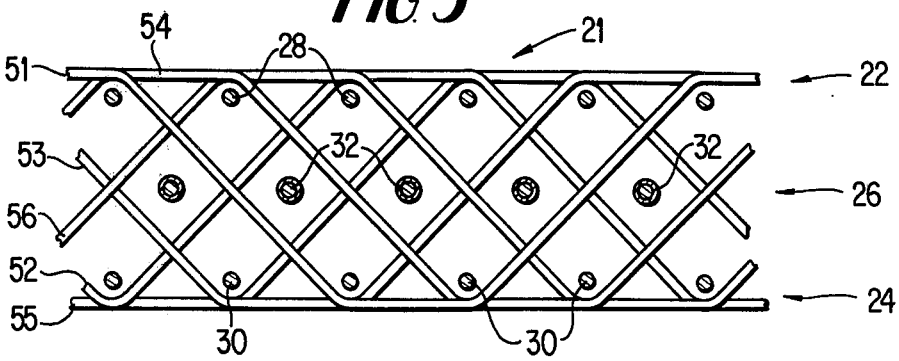
FIG. 3 is a longitudinal section of another duplex weave dryer felt employing the subject invention.

Another multi layer weave, generally designated as 21, is illustrated in FIG. 3, wherein like numerals denote like elements. As can be seen here, like in FIG. 2, a dryer felt can be woven to have a desired face configuration, while at the same time employing the encapsulated stuffer yarns of the subject invention.

Figure 4:
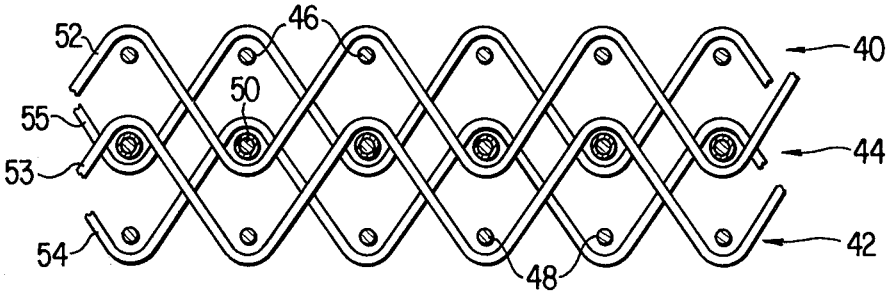
FIG. 4 is a longitudinal section of a triplex weave dryer felt employing the subject invention.

The subject invention may also be employed in a triplex weave dryer felt as illustrated in FIG. 4. A top plane or surface 40, which provides the face of the dryer felt, is defined by a plurality of cross machine direction yarns 46. The yarns 46 are made from a synthetic monofilament, a synthetic multifilament or spun fiber yarns. A bottom plane or surface 42, which provides the back of the dryer felt, is defined by a plurality of cross machine direction yarns 48. The yarns 48 are made from a synthetic monofilament, a synthetic multifilament or spun fiber yarns. An intermediate plane 44 is defined by a plurality of encapsulated filling yarns 50. The yarns defining the various planes are united or bound in place by a plurality of machine direction yarns 52 through 55, which are also made from a synthetic monofilament, a synthetic multifilament, or spun fiber yarns.

Obviously, many modifications and variations of the present invention are possible in light of the above teachings. It is, therefore, contemplated that the encapsulated yarns, used in the subject invention, may not replace all of the stuffer yarns or intermediate filling yarns in some dryer felts; and that the encapsulated yarns may be used to replace both stuffer yarns and intermediate filling yarns in other dryer felts. It is further contemplated that the diameter of the core fibers 10 and 12, as well as the diameter of the synthetic monofilament, the synthetic multifilament, or the spun fiber yarns used for the remaining yarns in the dryer felt are in the range of about 5 to 50 mils, with a range of about 15 to 35 mils being preferred. It is, therefore, to be understood that within the scope of the appended claims, the invention may be practised otherwise than as specifically described.

What I claim is:

1. A dryer felt comprising: a plurality of machine direction and cross machine direction yarns interwoven in a binding relationship to provide a multiple-plane fabric having at least a base plane, a top plane and an intermediate plane positioned between said base plane and said top plane, said base plane being defined by a first plurality of said cross machine direction yarns, said top plane being defined by a second plurality of said cross machine direction yarns, and said intermediate plane being defined by a third plurality of said cross machine direction yarns, wherein a plurality of the yarns of said third plurality are encapsulated yarns so as to provide a soft, bulky intermediate plane, each of said encapsulated yarns comprising a plurality of filaments treated with a heat resistant resin so that said filaments together act as a monofilament core, and an encapsulating sheath surrounding the full length of said core, said sheath defining a soft, bulky outer surface which, when woven into said fabric, acts to prevent shifting of said encapsulated yarns in said fabric, wherein said encapsulated yarns reduce fabric permeability while contributing to fabric stability.

2. The dryer felt according to claim 1, wherein all of the yarns of said third plurality are encapsulated yarns.

3. The dryer felt according to claim 1, wherein the yarns of said third plurality are stuffer yarns.

4. The dryer felt according to claim 1, wherein the yarns of said third plurality are filling yarns.

5. The dryer felt according to claim 1, wherein said sheath is made from a material chosen from the group consisting of asbestos, cotton, wool, synthetic fibers or aramid fibers.

6. The dryer felt according to claim 1, wherein said sheath is made from a material chosen from the group consisting of mineral fibers, natural fibers, and man-made fibers.

7. The dryer felt according to claim 1, wherein the filaments of said monofilament core are wire.

8. The dryer felt according to claim 1, wherein the filaments of said monofilament core are made from a treated glass fiber.

9. The dryer felt according to claim 1, wherein said resin is a phenolic resin.

10. The dryer felt according to claim 1, wherein the diameter of the monofilament core is in the range of about 5 to 50 mils.

11. The dryer felt according to claim 1, wherein the monofilament core is in the range of about 15 to 35 mils.

12. The dryer felt according to claim 1, wherein the monofilament core is made from a material chosen from the group consisting of polyesters, polyamides, aramids, polyolefins, and acrylics.

13. The dryer felt according to claim 1, wherein the monofilament core is a material chosen from the group consisting of polyesters, polyamides, aramids, and acrylics.

14. A method of making a dryer felt having encapsulated, bulky center yarns, the method comprising the steps of weaving a plurality of machine direction and cross machine direction yarns into a multiple-plane fabric having at least a base plane, a top plane and an intermediate plane positioned between said base plane and said top plane, said base plane being defined by a first plurality of said cross machine direction yarns, said top plane being defined by a second plurality of said cross machine direction yarns, said intermediate plane being defined by a third plurality of said cross machine direction yarns, and said plurality of machine direction yarns binding all of said cross machine direction yarns, wherein a plurality of the yarns of said third plurality are encapsulated yarns so as to provide a soft, bulky intermediate plane, each of said encapsulated yarns comprising a plurality of filaments treated with a heat resistant resin so that said filaments together act as a monofilament core, and an encapsulating sheath surrounding the full length of said core, said sheath defining a soft, bulky outer surface which, when woven into said fabric, acts to prevent shifting of said encapsulated yarns in said fabric, wherein said encapsulated yarns reduce fabric permeability while contributing to fabric stability.

15. The method according to claim 14, further comprising the step of selecting an encapsulated yarn having said monofilament core made from a synthetic material, and said sheath, made from a soft, bulky material, surrounding said monofilament core.

16. The method according to claim 15, further comprising the step of selecting said synthetic material for said monofilament core from the group consisting of polyesters, polyamides, aramids, polyolefins and acrylics.

17. The method according to claim 15, further comprising the step of selecting said soft, bulky material for said sheath from the group consisting of asbestos, cotton, wool, synthetic fibers, and aramid fibers.

18. The method according to claim 15, further comprising the step of selecting said soft, bulky material for said sheath from the group consisting of mineral fibers, natural fibers and man-made fibers.

* * * * *